US006447344B2

(12) United States Patent
Sato et al.

(10) Patent No.: US 6,447,344 B2
(45) Date of Patent: Sep. 10, 2002

(54) JOINT CONNECTOR

(75) Inventors: Kei Sato; Toshiaki Ozawa, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/797,846

(22) Filed: Mar. 5, 2001

(30) Foreign Application Priority Data

Mar. 6, 2000 (JP) ..... 2000-060895

(51) Int. Cl.[7] ..... H01R 13/502

(52) U.S. Cl. ..... 439/701

(58) Field of Search ..... 439/701, 752, 439/708, 709, 717, 714, 595, 404, 417

(56) References Cited

U.S. PATENT DOCUMENTS 5,895,296 A * 4/1999 Okabe ..... 439/701

OTHER PUBLICATIONS

Sato, Kei, "Joint Connector", application Ser. No.: 09/438,769 filed, Nov. 12, 1999.

* cited by examiner

*Primary Examiner*—Tho D. Ta
*Assistant Examiner*—Phuong Nguyen
(74) *Attorney, Agent, or Firm*—Finnegan, Henderson, Farabow, Garrett & Dunner, L.L.P.

(57) ABSTRACT

This invention provides a joint connector which keeps connector housings in parallel in its temporary setting condition so as to eliminate a joining failure and prevent an abnormal load from being applied on a tab. More specifically, this invention provides a joint connector allowing connector housings to be joined together through plural stages with its front face overlaid on its rear face, wherein in the temporary setting condition before the connector housings (3) are joined together, joining protrusions (5) formed on the front face **(3*a*) make contact with an opening peripheral portion of each of joining protrusion fitting holes (12) while connector temporary engaging faces (8*a*, 14*a*) of front face rear lock member (8) on the front face and back face rear lock member (14) on the back face (3*b*) are in contact with each other so as to maintain each of the connector housings (3,3)** in a predetermined attitude.

7 Claims, 12 Drawing Sheets

JOINT CONNECTOR

BACKGROUND OF THE INVENTION

As an example of a branch connector which branches wiring, a joint connector which joins together connector housings of the same structure through plural stages such that they are stacked has been proposed.

As shown in FIGS. 1 and 3, a front surface 101*a* of a connector housing 101 has front engaging members 102, rear engaging members 103, front lock members 104 and front surface rear lock members 105. On the other hand, a back face 101*b* has front engaging member insertion holes 106 in which front engaging members 102 are to be inserted, rear engaging member insertion holes 107 in which rear engaging members 103 are to be inserted and back face rear lock members 108 engaging with the front surface rear lock members 105.

When joining the both connector housings 101, 101 together, as shown in FIG. 1, the back face 101*b* of a connector housing 101 is placed so as to oppose the front surface 101*a* of the other connector housing arid overlaid thereon. Then, the connector housings 101, 101 in the temporary setting condition before joining are placed between an upper connector joining member 101 and a lower connector joining member 110 as shown in FIG. 2 and joined together by pressing from above.

The temporary setting condition before the joining means that as shown in FIG. 2, the front lock member 104 makes contact with the temporary engaging face 112 formed below the front lock member engaging hole 111 in which the front lock member 104 is to be inserted and engaged with and in a rear portion of the connector housings, as shown in FIG. 3, a connector temporary engaging face 108*a* of a back face rear lock member 108 makes contact with a connector temporary engaging face 105*a* formed on the front surface rear lock member 105.

If both the connector housings 101, 101 are tried to be joined together from this temporary setting condition, the front engaging member 102 is inserted into the front engaging member insertion hole 106 and at the same time, the rear engaging member 103 is inserted into the rear engaging member insertion hole 107, so that both the connector housings 101, 101 are positioned without being loosened in the back and forth direction and in the vertical direction.

In a front portion of this connector housing 101, the front lock member 104 is inserted into and engaged with the front lock member engaging hole 111 so that the housing front portion is locked. In the rear portion thereof, pawls of the front surface rear lock member 105 and the back face rear lock member 108 engage with each other so that the housing rear portion is locked. Consequently, both the connector housings 101, 101 are joined together in a joining direction so that they are not separated from each other and maintained in that condition.

Then, a height, at a contact position between the joined connector housings in the front lock portion (contact portion between the front lock member 104 and the temporary engaging face 112) is different from the height at the contact position in the rear lock portion (contact portion between the connector temporary engaging faces 105*a* and 105*a* of the front surface rear lock member 105 and the back face rear lock member 108). Thus, the connector housing 101 overlaid on the lower connector housing is inclined forward as shown in FIG. 2.

For this reason, if both the connector housings 101, 101 are tried to be joined together, likely prying action occurs at a joined portion due to unequal pressing force or a joined portion is damaged or the joining condition becomes incomplete.

In the connector housing 101, as shown in FIG. 4, a tab insertion hole 114 for introducing a tab 113 of a terminal into a terminal accommodating chamber 115 is formed in the back face 101*b*. When the connector housings are joined, a front tip of the tab 113 makes contact with an opening peripheral portion 114*a* of the tab insertion hole 114 so that a load is applied on the tab 113. If this load is too large, a front end stress of the tab 113 can not be dispersed so that the tab may be bent as shown by dotted line in the same Figure. Consequently, the tab cannot be connected to a terminal accommodated in the overlaid connector housing 101.

SUMMARY OF THE INVENTION

Accordingly, the present invention has been proposed to solve the above described problem and an object of the invention is to provide a joint connector capable of maintaining connector housings in parallel to each other without any joining failure in a temporary setting condition before the connector housings are joined together, and preventing any abnormal load from being applied to the tab.

To achieve the above object, the present invention provides a joint connector for joining together connector housings of the same structure each accommodating a plurality of terminals in its terminal accommodating chamber through plural stages, such that when the side of the terminal accommodating chamber is assumed to be a front surface while an opposite side thereof is assumed to be a back face, the back face is overlaid on the front surface.

In this connector housing, a front engaging member is formed near the front of the front surface and a joining protrusion is formed on this front engaging member. A first rear lock member is formed near the rear of the front surface and a first connector temporary engaging face having a tapered face is formed on this first rear lock member. Further, a front engaging member insertion hole in which a front engaging member is to be inserted is formed near the front of the back face and a joining protrusion fitting hole to which the joining protrusion is fit is formed in this front engaging member insertion hole. A second rear lock member to engage with the first rear lock member is formed near the rear of the back face and a second connector temporary engaging face having a tapered face is formed on the second rear lock member.

In the temporary setting condition before the connector housings are joined together, the joining protrusion makes contact with an opening peripheral portion of the joining protrusion fitting hole and at the same time, the first connector temporary engaging face and the second connector temporary engaging face make contact with each other, so that the respective connector housings are maintained in a predetermined attitude.

In the joint connector of the present invention, in the temporary setting condition before the connector housings are joined together, distances between the up and down connector housings in the front and rear portions are specified. Consequently, the joined connector housings keep the predetermined attitude. Therefore, in the temporary setting condition before the connector housings are joined, the attitude can be reproduced easily and maintained in a stabilized condition. Therefore, if the connector housings are tried to be joined together from this predetermined attitude, the front engaging member is inserted smoothly into the front engaging member insertion hole and the rear engaging member is also inserted into the rear engaging member insertion hole without any prying action. As a result, the both connector housings are joined together without any inclination.

DESCRIPTION OF THE PREFERRED EMBODIMENTS

This embodiment refers to a joint connector provided by joining two same connector housings vertically.

Structure of the Joint Connector

Figure 1:
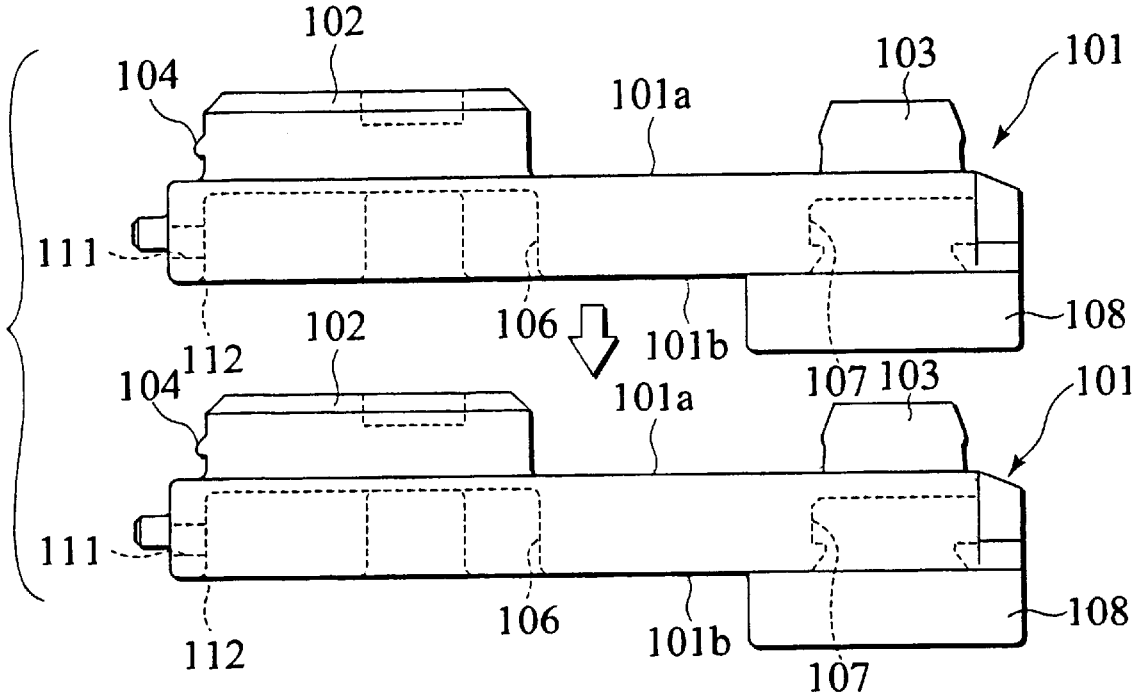
FIG.1 PRIOR ART
FIG. 1 is a side view showing a condition before conventional connector housings are joined.
Figure 2:
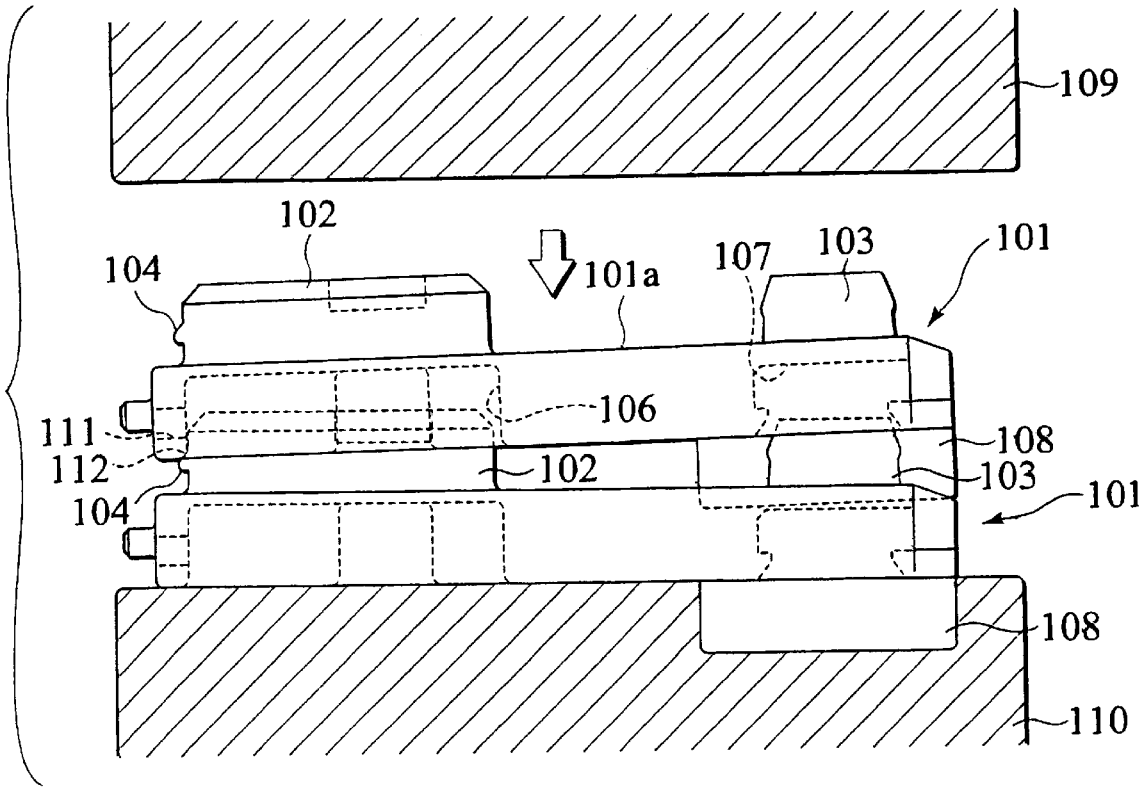
FIG.2 PRIOR ART
FIG. 2 is a side view showing a condition in which the conventional connector housings are joined from a temporary setting condition.
Figure 3:
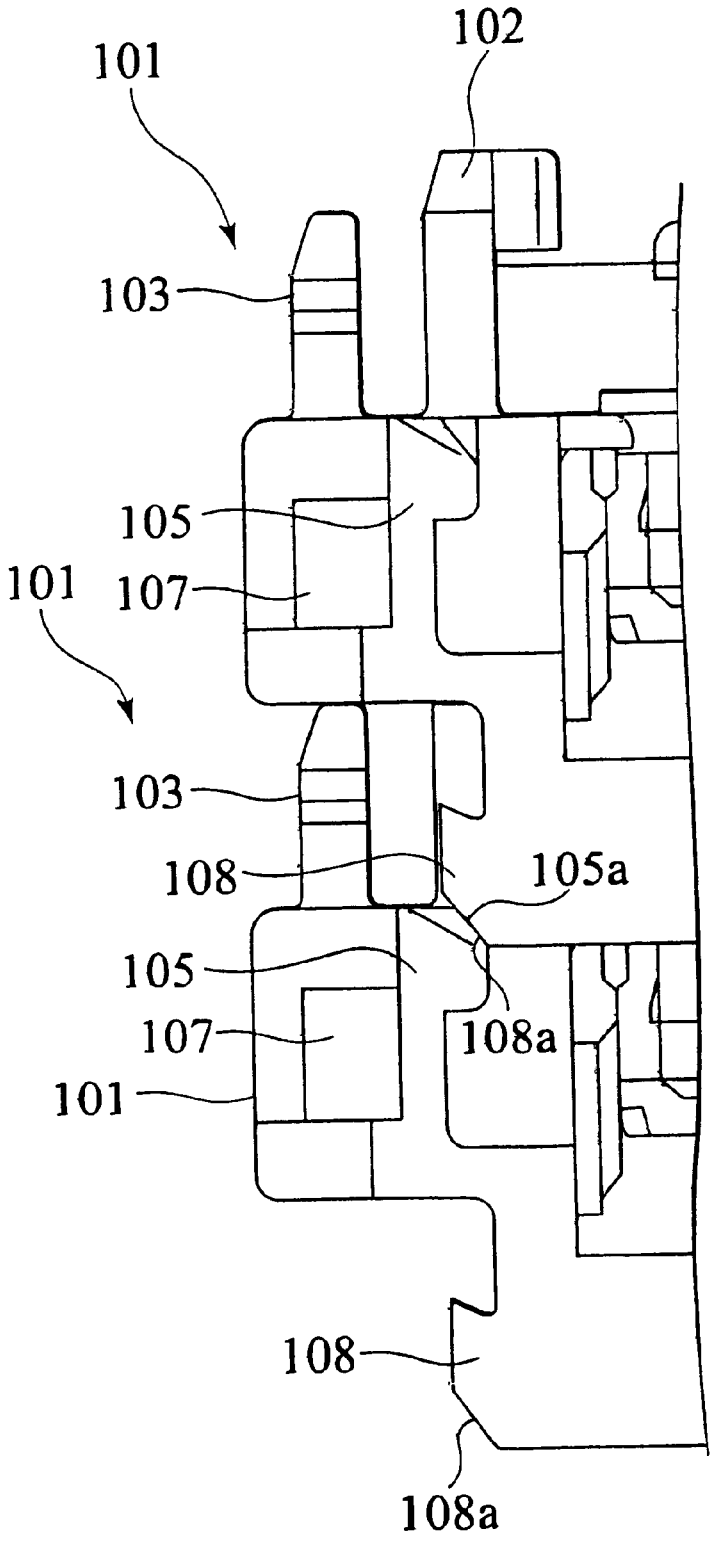
FIG.3 PRIOR ART
FIG. 3 is a front side showing enlarged major parts of a rear portion of the housing in the temporary setting of FIG. 2.
Figure 4:
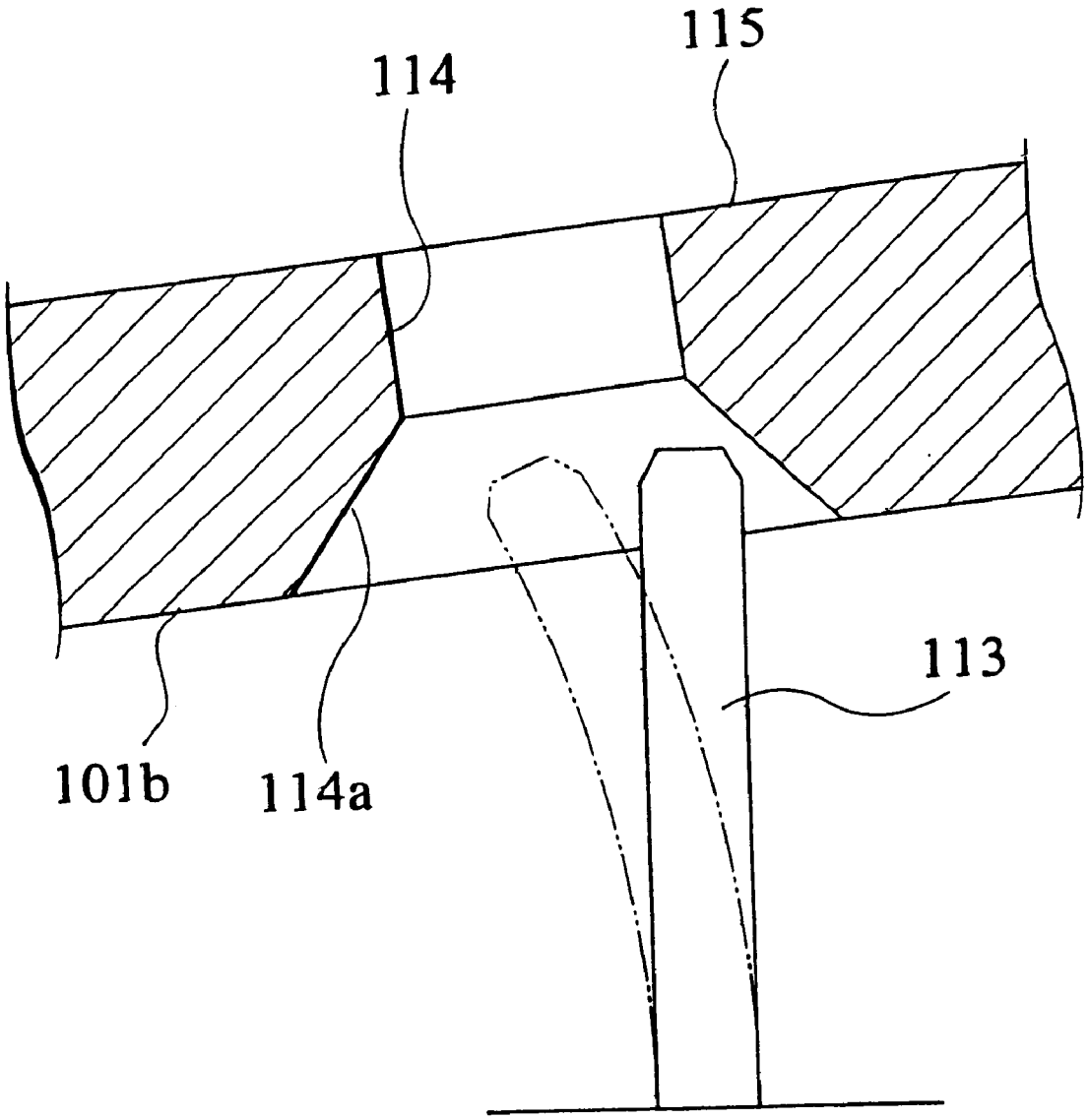
FIG.4 PRIOR ART
FIG. 4 is a sectional view of enlarged major parts showing a condition in which a tab makes a contact with a periphery of an opening of a tab insertion hole so that it is deformed in the conventional connector housing.
Figure 5:
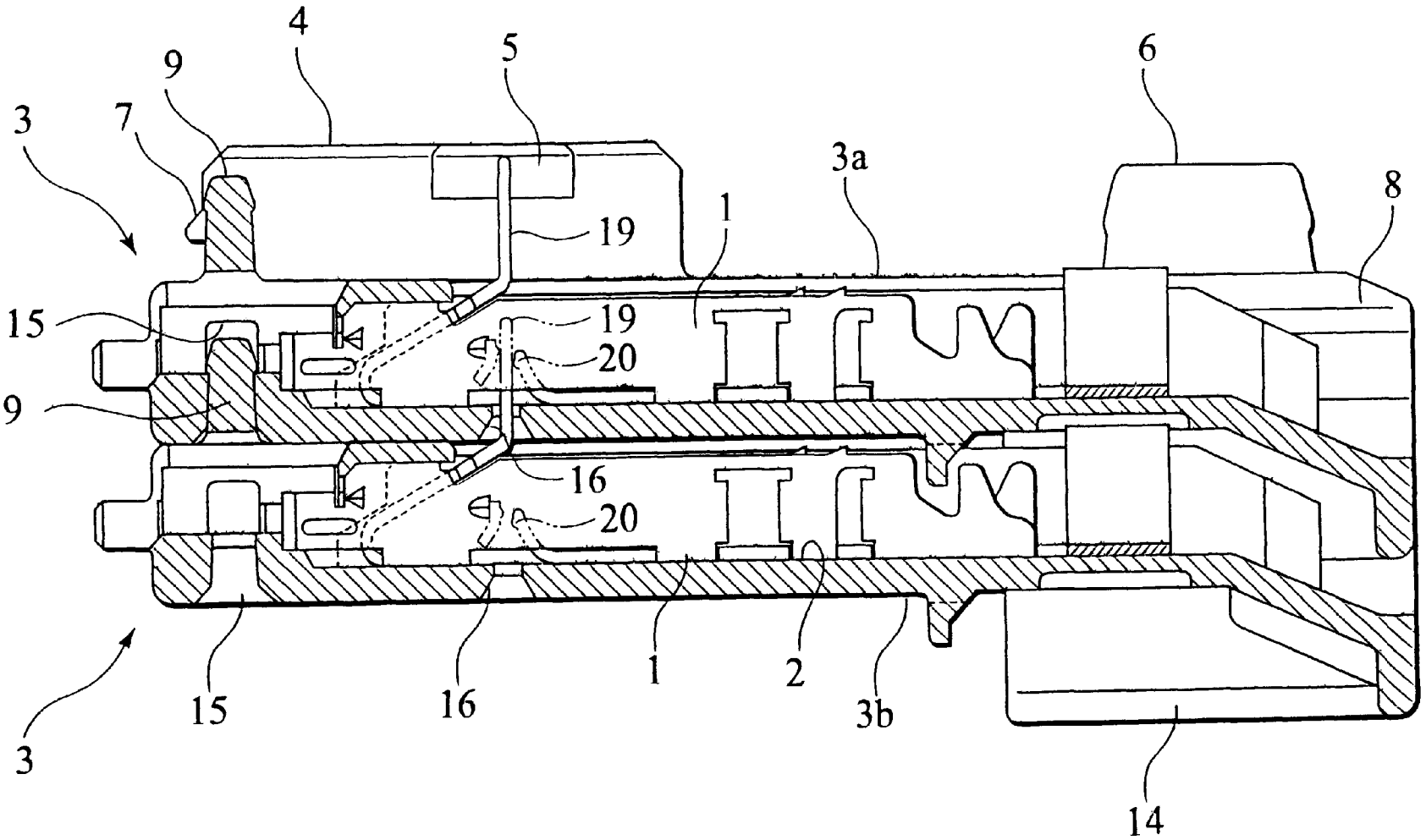
FIG. 5 is a sectional view of a joint connector of the embodiment.

According to the joint connector of this embodiment, as shown in FIG. 5, the connector housings 3 of the same structure accommodating a plurality of terminals 1 in its terminal accommodating chamber 2 are joined vertically to each other such that when the side of the terminal accommodating chamber 2 is designated a front surface 3*a* and its opposite side is designated a back face 3*b*, the back face of one connector housing is overlaid on the front surface 3*a* of the other connector housing.

Figure 6:
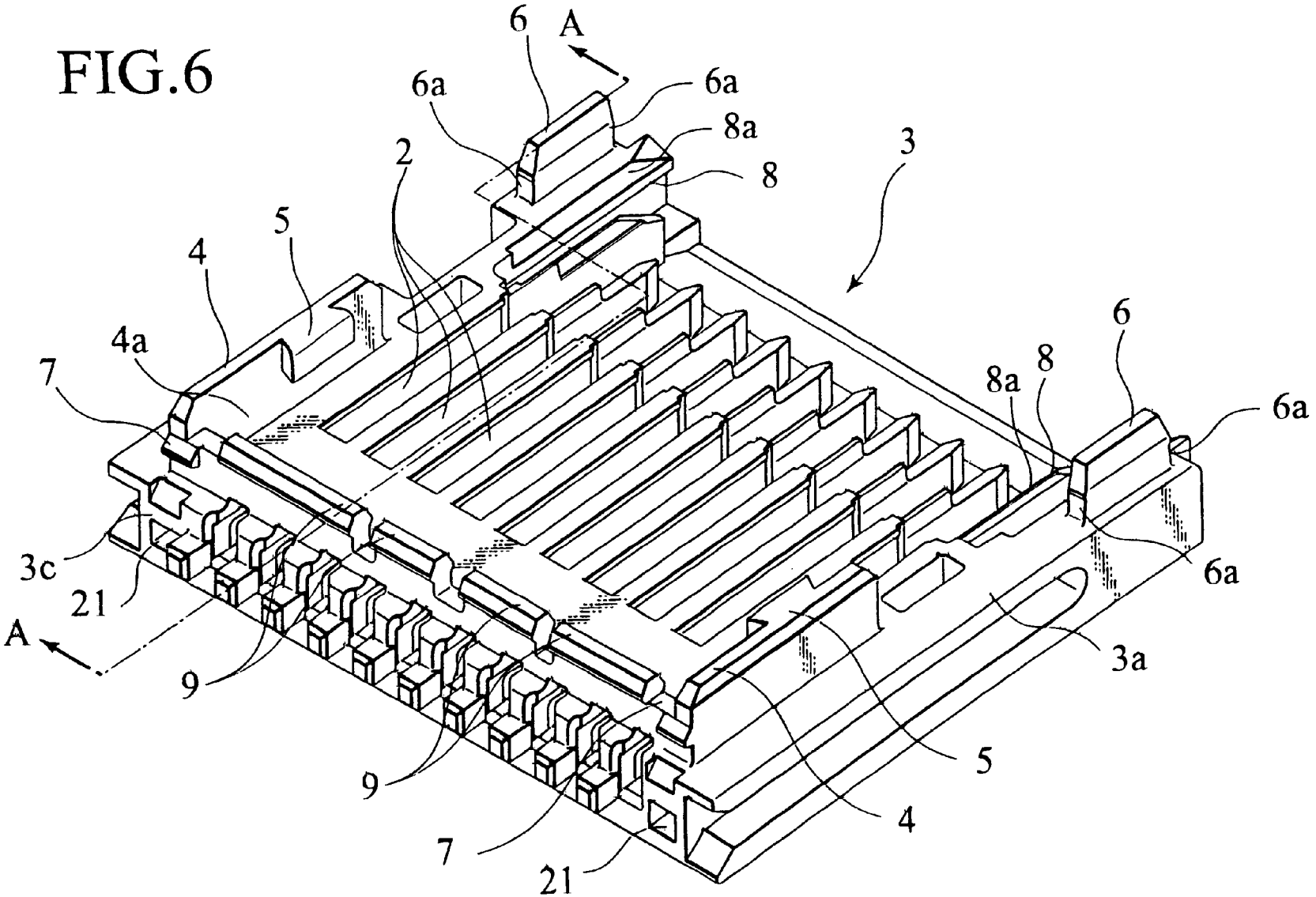
FIG. 6 is a perspective view showing a front surface of the connector housing.
Figure 7:
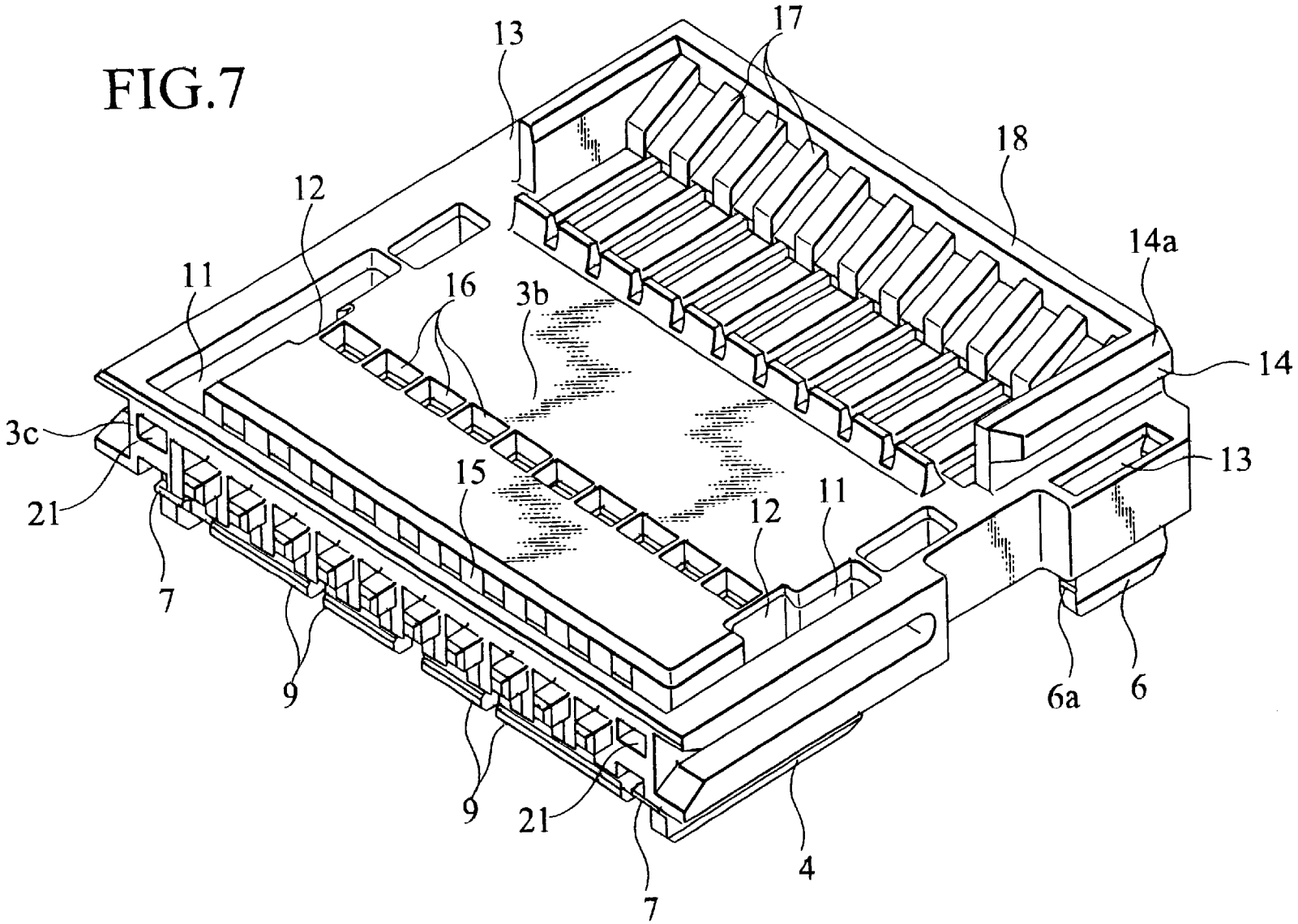
FIG. 7 is a perspective view showing a back face of the connector housing.
Figure 8B:
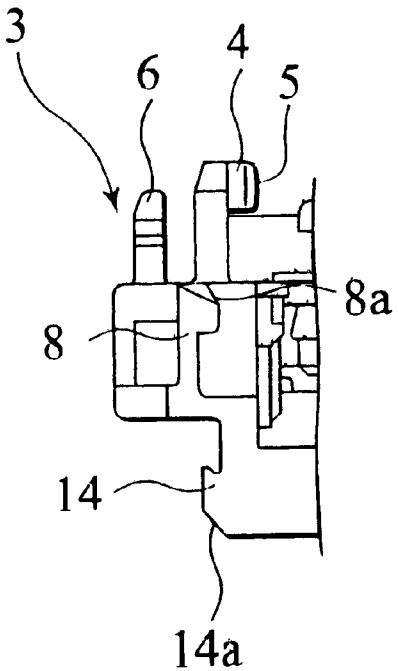
FIG. 8A is a longitudinal sectional view of the connector housing and FIG. 8B is a front view of major parts of a rear portion of the housing.
Figure 8A:
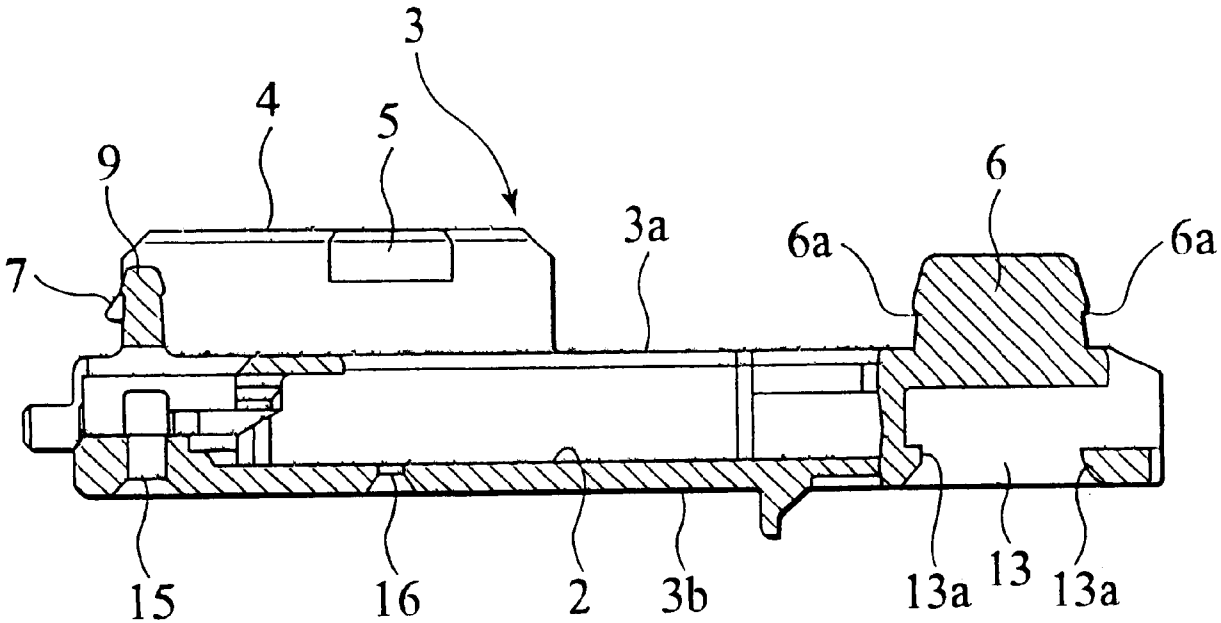

As shown in FIGS. 6 to 8, the connector housing is formed as a rectangular housing having the accommodating chamber 2 for accommodating a plurality of the terminals 1 at a predetermined interval and has protrusions and locking portions for joining on the front surface 3*a* and back face 3*b*.

As shown in FIG. 6, the front surface 3*a* of the connector housing 3 has front engaging members 4, joining protrusions 5 formed on each of the front engaging members 4, rear engaging members 6, front lock members 7, front surface rear lock members 8 and housing looseness killing members 9.

As shown in FIGS. 6 and 8, the front engaging member 4 is a rectangular connecting piece with a mating connector, provided on both sides of the connector housing 3 such that it is protruded upward. This front engaging member 4 prevents the housing front portion from being loosened in the back and forth direction and in the right and left direction.

As shown in FIGS. 6 and 8, the joining protrusion 5 is formed integrally with the front engaging member 4 to kill looseness between the connector housings 3 in the back and forth direction and in the right and left direction. The joining protrusion 5 is formed near a front end of the front engaging member 4 such that it is protruded from an inner face 4*a* of the front engaging members 4. The shape and size of this joining protrusion 5 will be described later.

As shown in FIGS. 6 and 8, the rear engaging member 6 is formed in the form of a rectangular piece, on a wire introducing side for introducing wire (not shown) connected to the terminal 1 accommodated in the terminal accommodating chamber 2 or on a rear side and on both sides of the connector housing such that it is protruded upward. The rear engaging member 6 is provided more outside than the formation position of the front engaging member 4, so as to prevent the rear portion of the connector housing from being loosened in the back and forth direction and in the right and left direction.

As shown in FIGS. 6 and 8, the front lock member 7 is provided on a connecting side with the mating connector such that it is protruded from a front end of the front engaging member 4. This front lock member 7 is formed in the form of a protrusion having a substantially triangle section so as to lock a connecting condition with the connector housings 3 at the front portion thereof.

As shown in FIGS. 6 and 8, the front surface rear lock member 8 is formed on :the side of a base of the rear engaging member 6 such that it is located slightly below the surface 3*a*of the connector housing 3. As shown in FIG. 8(*b*), the front surface rear lock member 8 is formed in the form of a protrusion protruded inward and engages with a back face rear lock member, which will be described later, so as to lock a coupling condition of the connector housings at the rear portion thereof. This front surface rear lock member 8 has a connector temporary engaging face 8*a*, which is a tapered face. In a temporary setting condition before the connector housings are joined together, this connector temporary engaging face 8*a* makes a contact with a connector temporary engaging face 14*a* of a back face rear lock member 14.

A plurality of the housing looseness killing members 9 are provided on the connecting side with the mating connector in a direction substantially perpendicular to a connector mounting direction. As shown in FIG. 8, the housing looseness killing member 9 is inserted into a housing looseness killing member insertion hole 15 formed in the back face 3*b* of the connector housing 3 so that it engages therewith, so as to kill a looseness in a vertical direction between the connector housings 3.

As shown in FIG. 7, the back face 3*b* of the connector housing 3 includes a front engaging member insertion hole 11 in which the front engaging member 4 is to be inserted, joining protrusion fitting holes 12 in which the joining protrusions 5 are fit, rear engaging member insertion holes 13 in which the rear engaging members 6 are to be inserted, back face rear lock members 14 which engage with the front surface rear lock members 8, housing looseness killing member insertion hole 15 in which the housing looseness killing member 9 is to be inserted, tab insertion holes 16 and reinforcement ribs 17.

As shown in FIGS. 7 and 8, the front engaging member insertion holes 11 are formed in a back face opposing the front engaging members 4 as stopper holes. The afore mentioned front engaging members 4 are inserted into the front engaging member insertion holes 11 so as to prevent the front portion of the housing from being loosened in the back and forth direction and in the vertical direction.

Figure 9:
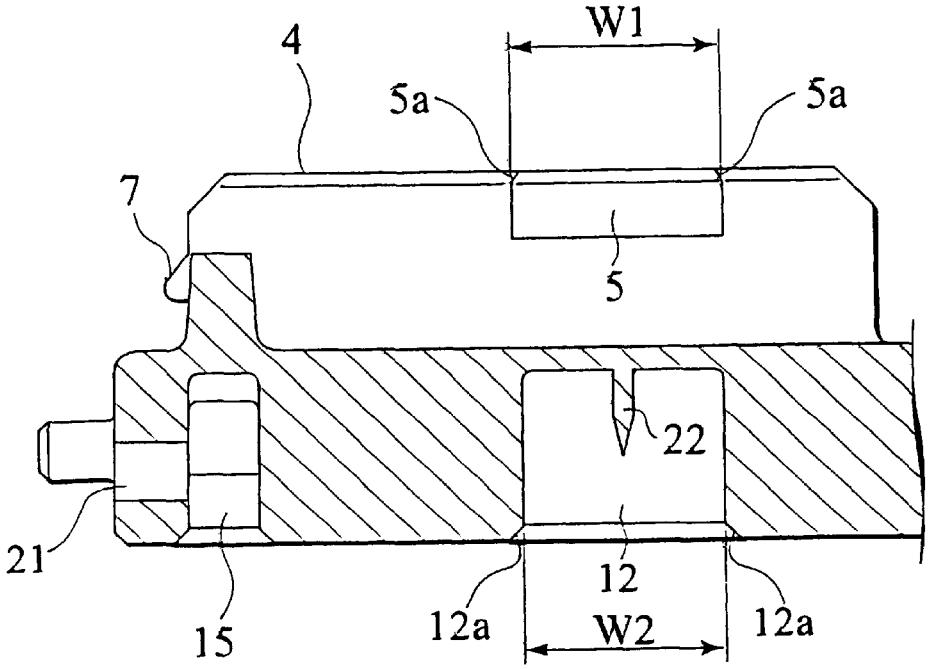
FIG. 9 is a longitudinal sectional view of enlarged major portions showing a joining protrusion and a joining protrusion engaging hole of the connector housing in enlargement.

As shown in FIGS. 7 and 9, the joining protrusion fitting holes 12 are formed in the back face opposing the joining protrusions 5 as stopper holes. The joining protrusion fitting holes 12 are connected with the front engaging member insertion holes 11. An inner wall of each of the joining protrusion fitting holes 12 has a joining force applying protruded row 22 for intensifying a joining force between the connector housings 3 and 3 by applying a urging force to a coupled joining protrusion 5.

Figure 10:
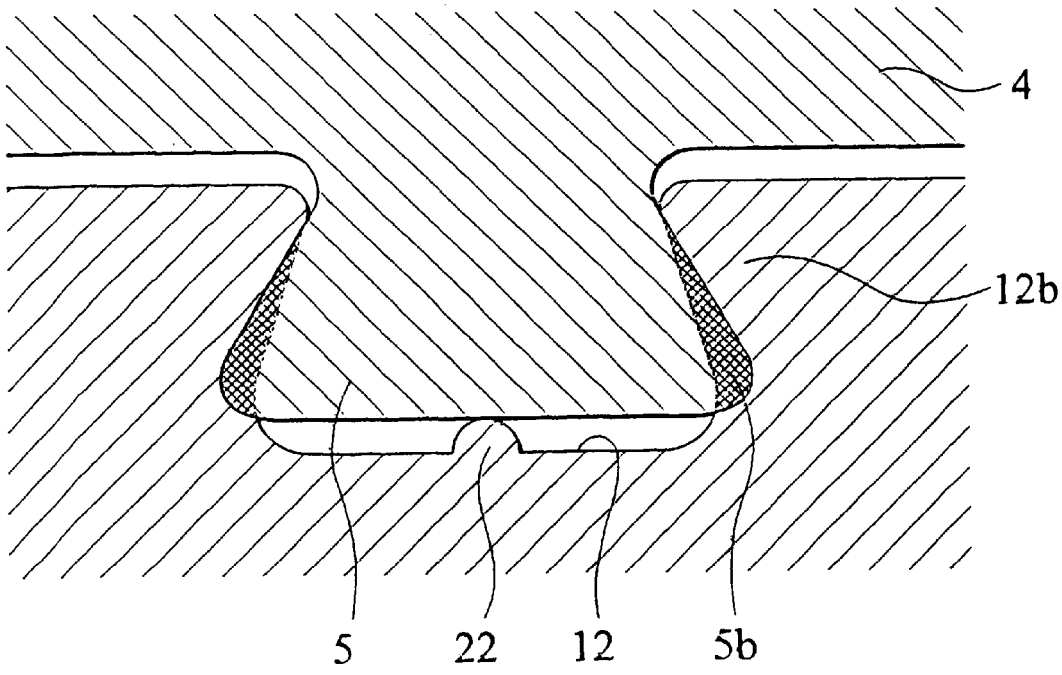
FIG. 10 is a lateral sectional view showing a joining protrusion and a joining protrusion engaging hole of the connector housing in enlargement.

As shown in FIG. 10, the joining protrusion 5 has a region 5*b*(shaded region in the same FIG.) overlapping part of the joining protrusion fitting hole 12 as viewed in sections of the both. That is, as shown in FIG. 9, the width W1 of the joining protrusion 5 is slightly larger than the width W2 of the joining protrusion fitting hole 12. In the temporary setting condition before the connector housings 3, 3 are joined together, part of the joining protrusion 5 engages with part of an opening peripheral portion 12*b* of the joining protrusion fitting hole 12 so that a predetermined distance is held between the connector housings. When the both connector housings are joined together completely, the joining protrusions 5 push and expand the joining protrusion fitting holes 12 by the amount of the overlapping portion.

In the temporary setting condition before the connector housings 3, 3 are joined together, as shown in FIG. 9, both front end portions 5*a*, 5*a* formed in a curved line like roundness (round shape) of the joining protrusion 5 make contact with opening both end portions 12*a*, 12*a* formed in the form of a tapered face of the joining protrusion fitting hole 12.

If the both front end portions 5*a*, 5*a* make contact with the opening both end portions 12*a*, 12*a*, a distance i.e. height H1 (hereinafter referred to as housing front height H1) of a front portion of the housing between the connector housings 3 and 3 is specified.

As shown in FIGS. 7 and 8, the rear engaging member insertion holes 13 are formed in the back face opposing the rear engaging members 6 as stopper holes. The rear engaging member insertion hole 13 has a flange portion 13*a*, which engages with a step portion 6*a* formed in the rear engaging member 6, so as to prevent the rear engaging member 6 from slipping out of the rear engaging member insertion hole 13.

Figure 11B:
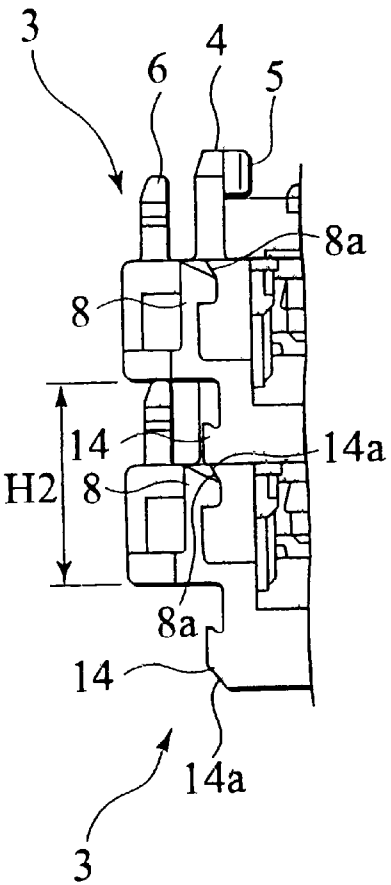
FIG. 11A is a longitudinal sectional view showing a connector housing placed in the temporary setting and FIG. 11(B) is a front view of major parts of a rear portion of the housing.
Figure 11A:
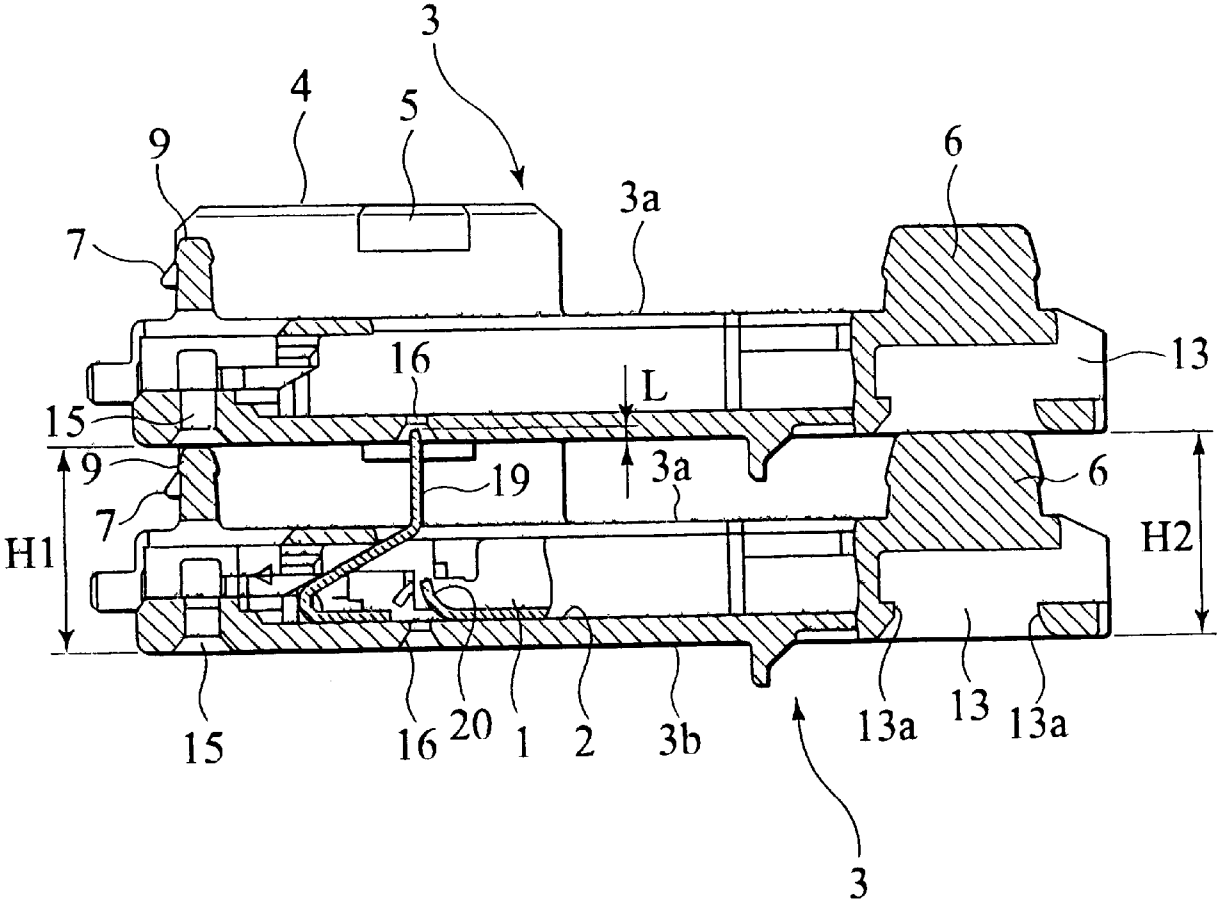
Figure 12:
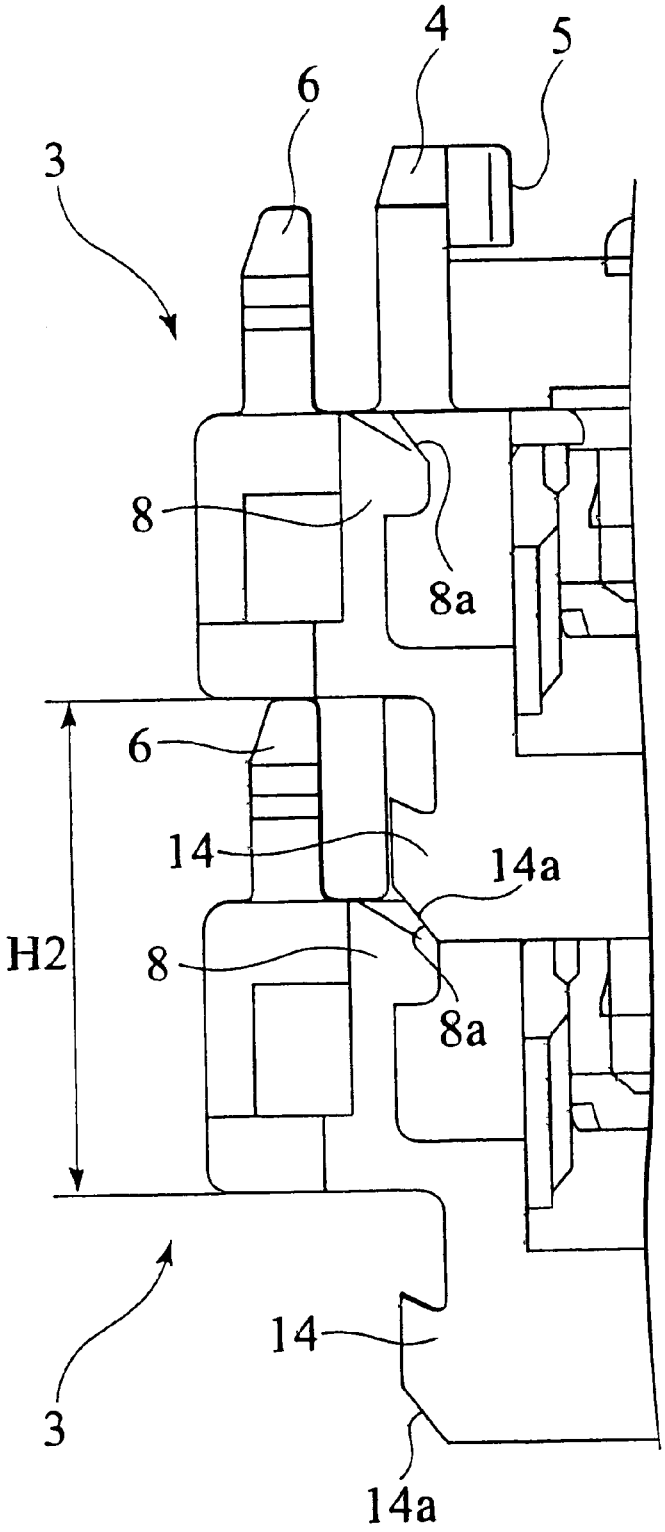
FIG. 12 is a front view of enlarged parts of a rear portion of the connector housing placed in the temporary setting.

As shown in FIGS. 7 and 8, the back face rear lock members 14 are formed on the back side opposing the front surface rear lock members 8. The back face rear lock members 14 are provided on top ends of a peripheral wall 18 formed in the shape of a substantially U letter surrounding the reinforcement ribs 17 such that they are protruded. The back face rear lock member 14 has a connector temporary engaging face 14*a* which is a tapered face. In the temporary setting condition before the connector housings 3, 3 are joined together, the connector temporary engaging face 14*a* makes a plane contact with the connector temporary engaging face 8*a* of the front surface rear lock member 8. Therefore, because the front surface rear lock member 8 and the back face rear lock member 14 make contact with each other through their connector temporary engaging faces 8*a*, 14*a*, attitudes of the connector housings in the back and forth direction and in the right and left direction in terms of their position, angle and the like are specified. At the same time, as shown in FIGS. 11 and 12, a distance i.e. height H2 (hereinafter referred to as housing rear height H2) of a rear portion of the housing between the connector housings 3 and 3 is specified.

Therefore, in the temporary setting condition of the connector housings 3, the housing front distance and the housing rear distance are specified by the housing front height H1 and the housing rear height H2, so that the up/down connector housings 3, 3 can be kept in their predetermined attitudes without being inclined.

The joint connector of the present invention is capable of specifying the attitude which allows a pressing load to the housings, to be joined together, to be applied with an appropriate direction and distribution such that that attitude can be reproduced easily and maintaining it stably, in the temporary setting condition before the connector housings are joined together. According to this embodiment, the housings 3, 3 before joined together are maintained in the same attitude and/or in parallel to the attitude after they are joined together.

As shown in FIGS. 7 and 8, the housing looseness killing member insertion hole 15 is formed in the back face opposing the housing looseness killing members 9 such that it is connected to the front engaging member insertion holes 11 on both sides so as to form an entirely substantially U-shaped hole. If the housing looseness killing members 9 are inserted into the housing looseness killing member insertion holes 15, looseness between the connector housings 3 and 3 in the vertical direction is killed.

As shown in FIGS. 7 and 8, the tab insertion hole 16 formed as an opening through which a tab 19 formed on the terminal 1 accommodated in each terminal accommodating chamber 2 is to be inserted. As shown, in FIG. 5, the tab 19 inserted from the tab insertion 16 into the terminal accommodating chamber 2 makes a contact with a tab contact portion 20 formed on the terminal 1 so as to make the up/down terminals 1, 1 conductive with each other.

As shown in FIG. 7, the reinforcement ribs 17 are formed at the rear portion of the housing so that they take a role of intensifying mechanical strength of the connector housing 3. Then, a portion, in which this reinforcement ribs 17 are formed, is formed in a tapered bent form so as to protect the tab contact portion 20 by making it difficult for vibration from a wire to be transmitted to a contact point in the tab contact portion 20.

As shown in FIGS. 6 and 7, front lock member engaging holes 21, in which the front lock members 7 are to be inserted and engaged with, are formed in the front face 3*c* of the connector housing 3. If the front lock members 7 are inserted into and engaged with the front lock member engaging holes 21, coupling condition of the connector housings at the front portion thereof is locked.

Operation for Joining of the Connector Housings

A joining method of the connector housings 3 will be described. First, the terminal 1 connected to an end of wire is disposed in each of the terminal accommodating chambers 2 in the connector housing 3. Next, as shown in FIG. 11, the back face 3*b* of one connector housing 3 is overlaid on the front surface 3*a* of the other connector housing 3, so that these connector housings 3, 3 are placed in the temporary setting condition.

Figure 13:
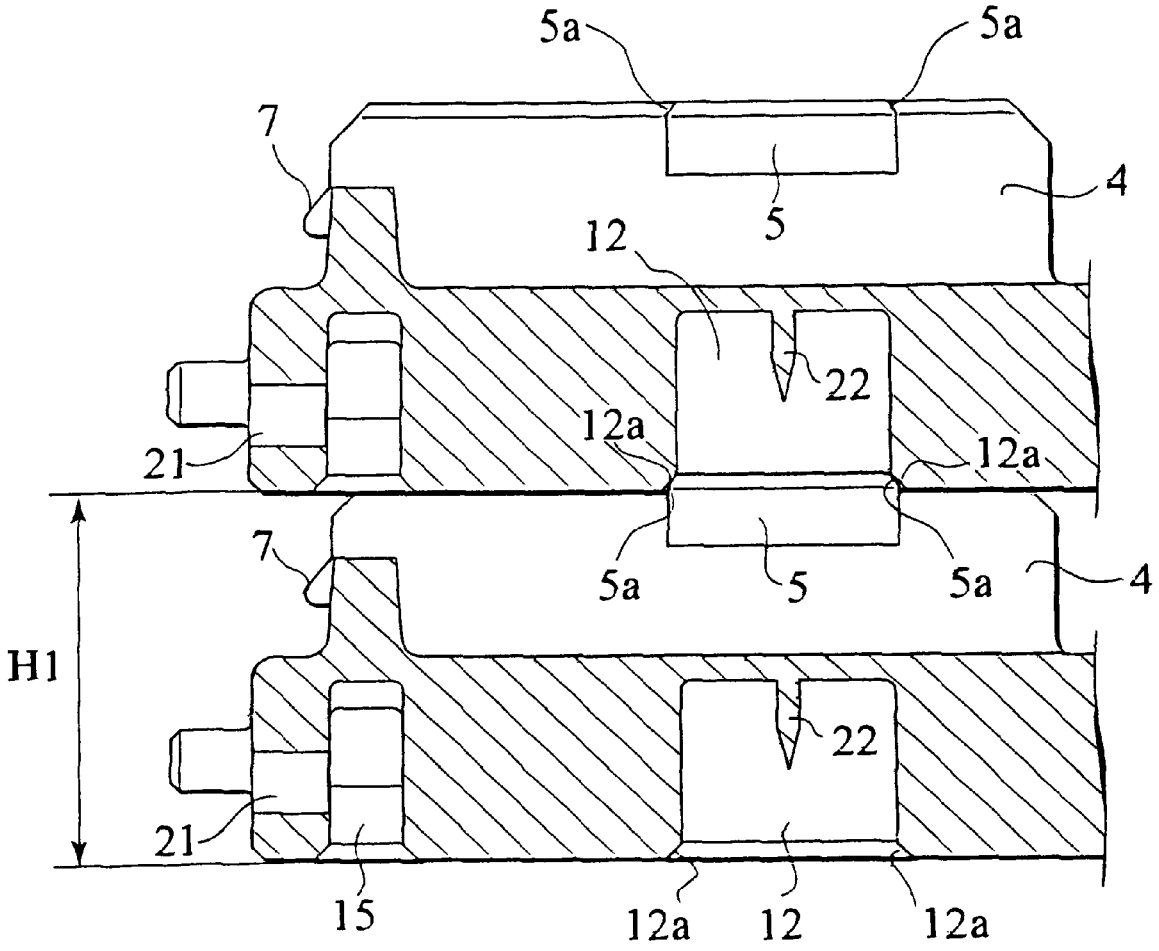
FIG. 13 is a longitudinal sectional view of enlarged major parts of a front portion of the connector housing placed in the temporary setting.

When the connector housings 3, 3 are placed in the temporary setting condition, the joining protrusion 5 is in contact with the opening peripheral portion of the joining protrusion fitting hole 12, because part of the joining protrusion 5 overlaps the joining protrusion fitting hole 12 as shown in FIG. 10. That is, as shown in FIG. 13, the front end portions 5*a*, 5*a* of the joining protrusion 5 make contact with the opening both end portions 12*a*, 12*a* so as to keep the housing front distance at the housing front height H1. On the other hand, at the rear portion of the housing placed in the temporary setting condition, as shown in FIG. 12, the front surface rear lock member 8 and the back face rear lock member 14 make contact with each other through the connector temporary engaging faces 8*a*, 14*a*. As a result, the housing rear distance is kept at the housing rear height H2.

Because in the temporary setting condition, the housing front distance is equal to the housing rear distance, as shown in FIG. 11, the connector housings 3, 3 are kept in parallel to each other. In this temporary setting condition, as shown in FIG. 11, the front end of the tab 19 is inserted into the tab insertion hole 16 by a predetermined length L.

Next, the connector housings 3, 3 placed in the temporary setting condition are pressed from up and down using a joining jig (not shown). As a result, in the front portion of the housing, the front engaging members 4 are inserted into the front engaging member insertion holes 11, the joining protrusions 5 are fit to the joining protrusion fitting holes 12, the front lock members 7 are inserted into the front lock member engaging holes 21, the housing looseness killing members 9 are inserted into the housing looseness killing member insertion holes 15 and the tabs 19 are inserted into the tab insertion holes 16. Substantially at the same time, in the rear portion of the housing, the rear engaging members 6 are inserted into the rear engaging member insertion holes 13 and the front surface rear lock members 8 are engaged with the back face rear lock members 14.

Consequently, in both the connector housings 3, 3, the front lock members 7 are inserted into and engaged with the front lock member engaging; holes 21 so as to lock the housing front portion and the front surface rear lock members 8 are engaged with the back face rear lock members 14 so as to lock the housing rear portion. Each terminal 1 of the connector housings 3, 3 joined together in the vertical direction is made conductive because the tab 19 make contact with the tab contact portion 20. In the above described way, the joint connector is completed.

Because in the joint connector of this embodiment, not only the attitude of the connector housings 3, 3 in the back and forth direction and in the right and left direction is specified in the holding/temporary setting condition before the connector housings 3, 3 are joined together, but also the connector housings 3, 3 are maintained in parallel, a pressing force for joining them together is transmitted to every position in an appropriate direction at an appropriate timing. Therefore, if the connector housings 3, 3 are tried to be joined together from this parallel condition, the front engaging members 4 are inserted smoothly into the front engaging member insertion holes 11 and the rear engaging members 6 are also inserted smoothly into the rear engaging member insertion holes 13, because the pressing force coincides with the insertion directions of the respective members 4, 6. Consequently, the up/down connector housings 3, 3 are joined together completely without any inclination. Further, abnormal load on the tab 19 is reduced so that a contact failure caused by bending of the tab 19 is prevented.

The specific embodiments of the present invention have been described above. However, the present invention is not restricted to the above described embodiments and may be modified in various ways.

Although according to the above embodiment, two connector housings are joined together in the vertical direction, it is permissible to join three or four or more connector housings 3, 3. Particularly, because if a plurality of the connector housings 3, 3 are stacked, an inclination of the connector housings is increased, this inclination of the connector housings can be eliminated by applying the present invention.

According to the above described embodiment, the housing front distance is specified to the housing front height H1 and the housing rear distance is specified to the housing rear height H2, while the housing front distance H1 is equal to the housing rear distance H2. However, this may be changed for actual embodiment. That is, the feature of the joint connector of the present invention is that it specifies the attitude which allows the pressing load on the housings, to be joined together, to be applied in an appropriate direction with an appropriate distribution such that that attitude can be reproduced easily and maintains the housings in a stabilized condition. Therefore, the housing front distance and the housing rear distance may be specified depending on the shape and structure of the housings 2.

According to the present invention, in the temporary setting condition before the connector housings are joined together, the joining protrusions make contact with the joining protrusion fitting holes and the connector temporary engaging faces of the front face rear lock member and the back face rear lock member make contact with each other, so that the respective connector housings to be joined together are maintained in a predetermined attitude with its excellent reproducibility. If the connector housings are tried to be joined together from this condition, the front engaging members are inserted smooth into and engaged with the front engaging member insertion holes and the rear engaging members are also inserted smoothly into and engaged with the rear engaging member insertion holes without any prying. As a result, the up/down connector housings are joined together without any inclination. Therefore, a damage on the joining portion and joining failure can be eliminated thereby making it possible to intensify assembly accuracy, reliability and working efficiency largely.

According to the present invention, the connector housings placed in the temporary setting condition are specified in a predetermined attitude and in parallel to the attitude after they are joined together. Thus, when the connector housings are joined, the tab is moved to an appropriate position and in an appropriate direction. Therefore, the tab can be inserted smoothly into the tab insertion hole without tab's making contact with the opening peripheral portion of the tab insertion hole. As a result, an abnormal load can be prevented from being applied to the tab at the time of joining, thereby making it possible to prevent the tab from being damaged.

What is claimed is:

1. A joint connector for joining together connector housings having substantially the same structure, each of the connector housings comprising a first face having a front and a rear and a terminal accommodating chamber for accommodating a plurality of terminals, and a second face located opposite the first face, said second face having a front and a rear and being configured to be overlaid on said first face, wherein upon assembly, the second face of a first of the connector housings is overlaid on the first face of a second of the connector housings in a temporary setting condition defining a predetermined attitude between the first connector housing and the second connector housing prior to being joined, the joint connector comprising:

front engaging members formed adjacent the front of said first face;

joining protrusions formed on the front engaging members;

first rear lock members formed adjacent the rear of said first face;

first connector temporary engaging faces formed on the first rear lock members, each of the first connector temporary engaging faces having a tapered face;

front engaging member insertion holes formed adjacent the second face for receiving the front engaging members;

joining protrusion fitting holes formed in the front engaging insertion holes for receiving the joining protrusions, the joining protrusion fitting holes having tapered peripheral portions;

second rear lock members formed adjacent the rear of the second face for engaging with the first rear lock members; and second connector temporary engaging faces formed on the second rear lock members, the second connector temporary engaging faces each having a tapered face, wherein in the temporary setting condition prior to joining said first connector housing to said second connector housing, the joining protrusions contact the tapered peripheral portions of the joining protrusion fitting holes, and the first connector temporary engaging face contacts the second connector temporary engaging face so as to maintain said first connector housing and said second connector housing in the predetermined attitude.

2. The joint connector according to claim 1, wherein once joined, the first connector housing and the second connector housing define a joined attitude, and the predetermined attitude in the temporary setting condition is parallel to the joined attitude.

3. The joint connector according to claim 1, wherein at least part of the joining protrusions cover at least part of the tapered peripheral portions of the joining protrusion fitting holes.

4. The joint connector according to claim 1, further comprising:

rear engaging members formed adjacent the rear of the first face, the rear engaging members extending away from the first face; and rear engaging member insertion holes formed adjacent the rear of said second face for receiving said rear engaging members.

5. A connector housing for forming a joint connector comprising a plurality of said connector housings, wherein the connector housings are configured to provide a temporary setting condition prior to joining two or more of the connector housings, the connector housing comprising:

a first face defining a terminal accommodating chamber, a front and a rear;

a second face located opposite the first face and defining a front and a rear;

at least one front engaging member located adjacent the front of the first face, the at least one front engaging member having a joining protrusion including an end portion;

at least one front engaging member insertion hole for receiving at least one front engaging member, the at least one front engaging member insertion hole being located adjacent the front of the second face and having a joining protrusion fitting hole including a face portion for temporarily receiving the end portion of the joining protrusion;

at least one first rear lock member located adjacent the rear of the first face, the at least one first rear lock member having a first connector temporary engaging face;

at least one second rear lock member located adjacent the rear of the second face for engaging the at least one first rear lock member, the at least one second rear lock member having a second connector temporary engaging face for engaging the first connector temporary engaging face;

at least one rear engaging member located adjacent the rear of the first face; and at least one rear engaging member insertion hole located adjacent the rear of the second face for receiving the at least one rear engaging member;

wherein upon assembly of two or more of the connector housings, the second face of a first of the connector housings is temporarily placed on the first face of a second of the connector housings such that the end portion of the at least one joining protrusion of the second connector housing is engaged with the face portion of the joining protrusion fitting hole of the first connector housing, and the second connector temporary engaging face of the second connector housing is engaged with the first connector temporary engaging face of the first connector housing, thereby resulting in a temporary setting condition defining a predetermined attitude between the first connector housing and the second connector housing prior to joining the first connector housing to the second connector housing by fully inserting the at least one front engaging member into the at least one front engaging member insertion hole, and by fully inserting the at least one rear engaging member into the at least one rear engaging member insertion hole.

6. The connector housing according to claim 5, wherein once the at least one front engaging member has been fully inserted into the at least one front engaging member insertion hole, and the at least one rear engaging member has been fully inserted into the at least one rear engaging member insertion hole thereby joining the first connector housing and the second connector housing, the first connector housing and the second connector define a joined attitude between the first and the second connector housings that is parallel to the predetermined attitude.

7. The connector housing according to claim 5, wherein the face portion of the at least one front engaging member insertion hole defines a tapered portion, and the joining protrusion of the at least one front engaging member defines a rounded edge such that when in the temporary setting condition, the tapered portion receives the rounded edge, thereby positively locating the first connector housing with respect to the second connector housing prior to joining.

* * * * *